United States Patent [19]

King

[11] Patent Number: 4,496,404

[45] Date of Patent: Jan. 29, 1985

[54] COMPOSITION AND PROCESS FOR TREATMENT OF FERROUS SUBSTRATES

[75] Inventor: Peter F. King, Farmington Hills, Mich.

[73] Assignee: Parker Chemical Company, Madison Heights, Mich.

[21] Appl. No.: 611,663

[22] Filed: May 18, 1984

[51] Int. Cl.[3] ..... C23F 7/04

[52] U.S. Cl. ..... 148/6.14 R

[58] Field of Search ..... 148/6.14 R

[56] References Cited

U.S. PATENT DOCUMENTS 4,457,790 7/1984 Lindert ..... 148/6.14

*Primary Examiner*—Sam Silverberg

*Attorney, Agent, or Firm*—Arthur E. Kluegel

[57] ABSTRACT

A composition and process for treating ferrous substrates including black plate container bodies to inhibit in-process corrosion or rusting of the surfaces thereof by contacting the ferrous substrate with aqueous acidic composition containing controlled effective amounts of aluminum, fluoride, optionally a second metal selected from the group consisting of zirconium, titanium, hafnium and mixtures thereof and hydrogen ions to provide a pH on the acid side.

16 Claims, No Drawings

COMPOSITION AND PROCESS FOR TREATMENT OF FERROUS SUBSTRATES

BACKGROUND OF THE INVENTION

The present invention is broadly applicable to an improved composition and process for treating ferrous-base substrates susceptible to corrosion to impart corrosion resistance to the surfaces thereof inhibiting the formation of rust spots during in-process operations prior to final surface treatment such as coating, lacquering, painting or the like. The benefits of the present invention are particularly adapted for the treatment of container bodies comprised of low-carbon steel sheet, commonly referred to as black plate, which are readily fabricated employing conventional cupping and draw and ironing press operations. Such drawn and ironed black plate container bodies possess a desirable light-gray shiny steel surface appearance which provides for an attractive package after subsequent coating with a clear organic lacquer and the imprintation of ink indicia on the exterior surfaces thereof.

The sequence for manufacturing black plate container bodies conventionally comprises uncoiling a black plate steel strip having a protective oil layer on the surfaces thereof to which further drawing lubricants are applied after which the strip passes through a cupping press forming a preliminary cup-shaped disc which is transferred to a draw and ironing press producing an elongated cup-shaped body. The draw and ironing press operation usually employs supplemental coolants such as water or dilute aqueous emulsions to facilitate the drawing operation. The fabricated container bodies are thereafter transferred to a trimmer in which the upper edge is trimmed whereafter the trimmed container body is subjected to a washer cycle containing multiple stages usually including a pre-washing stage in which water containing a low concentration of a cleaner is applied followed by a cleaning step in which an alkali cleaner of conventional strength is applied to remove the various contaminating lubricants, protective oils, coolants and other contaminating substances on the surfaces thereof. The cleaned container bodies are thereafter subject to one or a plurality of water rinse stages whereafter they are transferred to a dry-off oven for complete drying and thereafter are subjected to one or a plurality of lacquering steps and exterior decorative printing steps. Typically, the exterior surface of the container body is first provided with a base coat and/or a decorative ink printing of suitable indicia which after drying is followed by a conventional exterior can lacquer coating which is cured and followed by an interior can lacquer coating of the types conventionally employed which thereafter is also cured. Should the "covering power" of the chosen layer be poor, the resultant container body to be commercially acceptable must retain the shiny, light-gray metallic appearance visible or partially visible through the lacquer coated areas.

It has been observed in the manufacturing sequence of such black plate container bodies, that rust spots sometimes appear if too much water is retained at localized areas of the can during the drying stage such as the dome, lip or points of contact between containers necessitating scrappage or reworking thereof. Inadvertent stoppages of the production line in which the container bodies are retained in the washer stages for prolonged time periods have also occasioned unsightly rust spots or streaks which may be visible even through a base coat and to which coatings may poorly adhere or unevenly spread on the container surfaces rendering them commercially unacceptable.

The foregoing problems are overcome in accordance with the practice of the present invention by applying an aqueous acidic treating composition to the black plate container body as an integral stage of the multiple-stage washer sequence whereby in-process rusting of the container bodies is prevented as a result of inadvertent line stoppages or excessive localized water concentrations in the dry-off oven thereby preserving the desirable shiny, light-gray surface appearance until final protection is provided by a lacquer or subsequent surface coating operation.

SUMMARY OF THE INVENTION

The benefits and advantages of the present invention are achieved in accordance with the composition aspects thereof, by providing an aqueous acidic treating composition containing a controlled effective amount of aluminum, fluoride and optionally, zirconium, titanium and/or hafnium. The aqueous treating composition further contains hydrogen ions present in an amount to provide an acidic pH within a range of about 2 up to about 5.5.

In accordance with the process aspects of the present invention, the aqueous acidic composition is applied to the ferrous-base substrate by immersion, flooding or preferably by spraying. The application of the aqueous treating composition to the container body can readily be integrated in the washer section of the container process system as an alternative to one of the multiple water rinse treatments without disruption of the container processing cycle. The aqueous treating composition can be applied at a temperature from about 80° up to about 180° F. for time periods as short as about 2 seconds up to about 5 minutes which can be varied in consideration of the preset washer sequence time cycle which typically provides a treatment of about 15 seconds to about 1 minute. The treatment of the steel surfaces provides sufficient corrosion protection to prevent in-process rusting without interfering with the application and adhesion of the subsequent ink, lacquer and/or protective coatings applied to the treated surfaces.

Additional benefits and advantages of the present invention will become apparent upon a reading of the Description of the Preferred Embodiments taken in conjunction with the specific examples provided.

DESCRIPTION OF THE PREFERRED EMBODIMENTS

In accordance with the composition aspects of the present invention, the aqueous acidic treating composition contains as its essential constituents, controlled effective amounts of aluminum, fluoride, optionally, a secondary metal such as zirconium, titanium and/or hafnium, and hydrogen ions to provide a pH on the acid side.

The aluminum can be introduced into the bath by any bath soluble and compatible aluminum salt such as hydrated aluminum sulfate, aluminum fluoride, or the like of which aluminum sulfate in the hydrated form comprises a preferred compound. The aluminum is employed in the operating composition up to or beyond its solubility limit, usually at a concentration of about 10 ppm up to about 5000 ppm, with concentrations of about 25 ppm to about 250 ppm being preferred.

The fluoride can be introduced into the aqueous acidic composition in the form of a simple or complex fluoride compound such as hydrofluoric acid or a simple or bifluoride salt of an alkali metal or ammonium or as a complex fluoride acid or salt based on an element such as boron, silicon, aluminum, zirconium, hafnium, titanium or the like. The fluoride concentration can range from as low as about 5 to ppm up to about 200 ppm or higher with amounts ranging from about 10 to about 150 ppm being usually preferred. The fluoride concentration is controlled in consideration to the quantity of the aluminum present, the specific characteristics of the ferrous-base substrate being treated, the temperature at which the treating composition is applied and the duration of the treatment time.

The zirconium, titanium and/or hafnium can be introduced into the bath by any compound which is soluble in the aqueous acidic medium and which does not contribute deleterious components to the treating composition. Compounds suitable for use include bath soluble zirconium compounds such as fluozirconic acid, ammonium and alkali metal fluozirconates, zirconium fluoride, zirconium sulfate, or the like; bath soluble hafnium compounds such as hafnium oxide, acids and salts based on hafnium and hafnyl nitrate, fluoride, chloride or the like; bath soluble titanium compounds such as potassium titanium fluoride, zirconium titanium fluoride, titanium fluoride, titanium sulfate or the like. The use of an alkali metal fluozirconate, such as, for example, potassium fluozirconate ($K_2ZrF_6$) is usually preferred in that it simultaneously introduces both zirconium and fluoride into the treating composition. The concentration of the zirconium, titanium and/or hafnium can broadly range up to about 1000 ppm and even higher with amounts ranging from about 40 ppm to about 320 ppm being preferred. A typical concentration of the zirconium, titanium and/or hafnium in an operating solution is about 80 ppm.

In addition to the foregoing, the aqueous composition contains hydrogen ions present in a concentration to provide an operating pH of from about 2 to about 5.5. At a pH level of above about 5.5, no apparent surface treatment or coating is produced and no inhibition against corrosion is provided. The specific pH of the treating composition employed will vary in consideration of the duration of treatment, the temperature of the bath, the pressure of spray application as well as the concentration of other constituents present in the treating composition. Generally, at processing times of about 30 seconds up to about 1 minute at composition temperatures of about 120° F. and at normal spray pressures, a pH ranging from about 4 up to about 4.5 has been found particularly satisfactory at normal concentrations of the remaining constituents.

The aqueous acidic treating composition at the desired operating concentration is conveniently prepared by forming a concentrate of the active constituents which is subsequently diluted with water. Makeup or replenishment concentrates can typically contain from about 1 to about 25 g/l aluminum, preferably about 2.5 to about 10 g/l aluminum, about 0.1 to about 5 g/l fluoride, optionally, up to about 10 g/l zirconium, titanium and/or hafnium, and hydrogen ions to provide a pH of about 0 to about 4.

In accordance with the process aspects of the present invention, an aqueous acidic composition of the foregoing formulation is applied to the surfaces of the ferrous substrates to be treated at a temperature ranging from 80° to about 180° F. and preferably from about 90° to about 130° F. The duration of contact can range from about 2 seconds up to about 5 minutes with contact times of about 5 seconds to about 1 minute being preferred. While the treating composition can be applied such as by immersion or flooding, spray application is preferred in that the washer section adapted for cleaning black plate container bodies conventionally employs spray application because of the configuration of the articles in order to assure uniform surface contact. The application of the treating composition can be performed in the second stage of a typical three-stage washer sequence; in the third stage of a typical five-stage washer cycle; or in the fourth stage of a typical six-stage washer sequence. In the six-stage washer cycle, the fourth stage treatment is followed by a typical water rinse stage and finally a deionized water rinse prior to dry-off in a recirculating air oven. The particular duration of contact during the treatment cycle will be dictated by the preset washer time cycle and the temperature and concentration of the treating composition is accordingly adjusted within the prescribed range of concentrations and operating temperatures to achieve appropriate treatment.

In order to further illustrate the present invention, the following examples are provided. It will be understood that the examples are provided for illustrative purposes and are not intended to be limiting of the scope of the invention as herein described and as set forth in the subjoined claims.

EXAMPLE 1

An aqueous acidic concentrate suitable for dilution with water to form an operating treating composition is prepared containing 6.5 g/l of fluoboric acid, 8 g/l of potassium fluozirconate, 130 g/l of hydrated aluminum sulfate containing about 14 molecules of water and the balance water. The pH of the concentrate is about 0.7.

An operating bath is prepared by adding 3 liters of the foregoing concentrate to 140 liters of water providing about a 2.1 percent by weight concentration of the concentrate in the operating bath. The pH is adjusted between about 3.8 to about 4.5.

A black plate container body is subjected to a five-stage wash cycle comprising an alkaline cleaner stage, water rinse, treatment for one minute with the treating composition as hereinabove described, water rinse and a final deionized water rinse. The cleaned, treated and rinsed container body with excess water left in the dome of the can is thereafter dried at 325° F. Upon drying, no rust is visible on the container surface.

Black plate cans processed on a conveyorized pilot can washer employing the same wash cycle were stopped in process for a period of one-half hour. The cans in stage two showed evidence of rust whereas the containers in stages one, four and five did not exhibit any visible rust.

EXAMPLE 2

In a pilot two-piece can washer, black plate can bodies incorporating lubricant on the surfaces thereof from the prior forming operations were subjected to a five-stage wash cycle as described in Example 1. All of the pilot treating tanks were of substantially equal length such that treatment times in the individual sections were nominally about 40 seconds. The cans were cleaned with an alkaline cleaner, tap water rinsed, and thereafter treated with an aqueous acidic treating composition according to the present invention containing 200 ppm (0.2 g/l) of aluminum, about 75 ppm (0.075 g/l) of $HBF_4$, about 80 ppm (0.08 g/l) zirconium and hydrogen ions to provide a pH of about 4.4. The aqueous acidic treating composition was applied at 120° F. for a period of 40 seconds whereafter the treated cans were tap water rinsed followed by a deionized water rinse.

The thus treated cans when stopped in the pilot can washer following treatment with the aqueous acidic treating composition showed no rust after standing for a period of 35 minutes. In comparison, similar cans which had been cleaned and rinsed, but not subjected to the treatment of the present invention evidenced rusting almost immediately.

EXAMPLE 3

Black plate can bodies were processed in accordance with the processing sequence as described in Example 2 but with the exception that the pH of the aqueous acidic treating composition was adjusted to 3.5. The treated cans following rinsing were oven dried at a temperature of about 380° F. for a period of about 3 minutes. The oven-dried cans exhibited a golden brown discoloration after oven drying which is commercially unacceptable when such cans are to be subjected to only a clear lacquer finish and to which organic finishes would probably adhere poorly.

EXAMPLE 4

Black plate can bodies were processed in accordance with the same sequence as described in Example 3 with the exception that the pH of the aqueous treating composition was adjusted to 5.5. After processing including the oven-dry step, the cans appeared bright and shiny without any significant discoloration. Some of the oven-dried cans, however, showed evidence of localized discoloration in the domes, lips and points of contact with adjacent cans. Certain cans were withdrawn from the line prior to the oven-drying step and while standing wet, were observed to rust relatively rapidly.

EXAMPLE 5

A series of aqueous acidic treating compositions was prepared corresponding to the composition as described in Example 1 but in which variations were made in the type of secondary metals present, and a control composition was also prepared containing only fluoride devoid of any aluminum and secondary metals. As a source of zirconium, the compound $K_2ZrF_6$ was employed; as a source of hafnium, the compound $HfO_2$ was employed; and as the source of titanium, $H_2TiF_6$ was employed. Black plate cans were processed employing a 19 liter spray tank using the same processing sequence as described in Example 1 with a 1 minute spray duration of the several treating compositions. All of the treating compositions were applied at a pH of about 4.3. These compositions contained aluminum, fluoride and individual examples of the secondary metals at a concentration of 80 ppm (0.08 g/l). In one composition, the zirconium was present at 50 ppm.

Following an oven drying of the treated black plate cans, the appearance of the body and dome was observed. The comparative results are set forth in Table 1.

TABLE 1

Effect of Zr, Hf, and Ti on corrosion and can appearance after oven drying.
Processing: 60 sec., 120° F., pH adjusted ($NH_4HCO_3$) to 4.3, fluoride 100 ppm as $HBF_4$

| | Secondary | | Result | |
|---|---|---|---|---|
| Al (ppm) | Metal | (ppm) | Body | Dome |
| 100 | — | — | Light | No stain |
| — | Zr | 50 | Dark | Stain |
| — | — | — | Dark | Stain |
| 100 | Zr | 80 | Light | Stain |
| 200 | Zr | 80 | Light | No Stain |
| 20 | Ti | 80 | Dark | Stain |
| 200 | Ti | 80 | Light | No Stain |
| 0 | Hf | 80 | Dark | Stain |
| 200 | Hf | 80 | Light | No Stain |

In accordance with the comparative results as set forth in Table 1, none of the black plate cans treated with an aqueous acidic composition containing fluoride sustained any rusting after oven drying. It is evident that a treatment of the black plate cans employing the fluoride does effect some general discoloration of the exterior can surface but that such discoloration is surprisingly and unexpectedly reduced by the presence of aluminum.

A further comparative test was conducted employing an aqueous acidic composition devoid of any fluoride and containing only aluminum at a concentration of 250 ppm and at a pH of about 4.3. Dome rusting occurred during the oven drying step in the presence of excessive water in the dome of the can.

EXAMPLE 6

The interrelationship of the composition and processing parameters in establishing optimum conditions is illustrated by this example. The effect of pH of the treating composition on the appearance of the treated cans was evaluated employing two different compositions which were spray applied under identical conditions for contact times of only 5 seconds employing a constant temperature of 120° F. and a constant fluoride concentration. A first set of cans cleaned in accordance with the procedure described in Example 1 was subjected to treatment at 5 seconds employing a composition containing 100 ppm fluoride as $HBF_4$, 200 ppm aluminum and no secondary metal. A second set of cans similarly cleaned was also treated for a period of 5 seconds employing a treating composition containing 100 ppm fluoride introduced as $HBF_4$, no aluminum and 50 ppm zirconium. The results are summarized in Table 2.

TABLE 2

Effect of Zr, Al and pH at 5 sec. processing time on corrosion and can appearance during line stoppages.
120° F., fluoride 100 ppm as $HBF_4$ - cans air dried

| | | Result | |
|---|---|---|---|
| Metal (ppm) | pH | Body | Dome |
| Al 200 | 5.0 | Light | Rust and Stain |
| Al 200 | 4.6 | Light | Rust and Stain |
| Al 200 | 4.1 | Light | No Stain |
| Al 200 | 3.2 | Light | No Stain |
| Al 200 | 2.9 | Light | No Stain |
| Al 200 | 2.0 | Light | Rust and Stain |
| Zr 50 | 5.0 | Light | Rust and Stain |
| Zr 50 | 4.4 | Light | No Stain |
| Zr 50 | 4.1 | Light | No Stain |
| Zr 50 | 3.8 | Light | No Stain |
| Zr 50 | 3.0 | Light | Stain |

TABLE 2-continued

Effect of Zr, Al and pH at 5 sec. processing time on corrosion and can appearance during line stoppages.
120° F., fluoride 100 ppm as $HBF_4$ - cans air dried

| Metal (ppm) | pH | Result | |
|---|---|---|---|
| | | Body | Dome |
| Zr 50 | 2.5 | Dark | Rust and Stain |

As will be noted in Table 2, optimum results at 5 second processing times were obtained at a treating composition pH above 2 and below 4.6 with the treating composition containing aluminum but no zirconium. For the composition containing only zirconium and devoid of any aluminum, optimum treating results were obtained at a treating composition pH above 3 and below 5.

The foregoing Examples clearly demonstrate the essential contribution of fluoride to prevent or substantially inhibit rusting of the black plate cans and the effectiveness of the aluminum to prevent objectionable discoloration of the cans by the treatment.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A process for treating ferrous substrates to inhibit surface corrosion thereof which comprises the steps of contacting the ferrous substrate with an aqueous acidic composition containing aluminum present in an amount up to it solubility limit, fluoride present in an amount up to about 200 ppm, up to about 1000 ppm of a second metal selected from the group consisting of zirconium, titanium, hafnium and mixtures thereof and hydrogen ions to provide a pH of about 2 to about 5.5, and thereafter rinsing the treated ferrous substrate.

2. The process as defined in claim 1 including the further step of controlling the temperature of said composition within a range of about 80° to about 180° F.

3. The process as defined in claim 1 including the further step of controlling the temperature of said composition within a range of about 90° to about 130° F.

4. The process as defined in claim 1 in which the step of contacting the ferrous substrate with said aqueous acidic composition is performed for a period of time ranging from about 2 seconds to about 5 minutes.

5. The process as defined in claim 1 in which the step of contacting the ferrous substrate with said aqueous acidic composition is performed for a time ranging from about 5 seconds to about 1 minute.

6. The process as defined in claim 1 including the further step of controlling the concentration of aluminum within a range of about 10 to about 5000 ppm.

7. The process as defined in claim 1 including the further step of controlling the concentration of aluminum within a range of about 25 to about 250 ppm.

8. The process as defined in claim 1 including the further step of controlling the concentration of fluoride within a range of about 5 to about 200 ppm.

9. The process as defined in claim 1 including the further step of controlling the concentration of fluoride within a range of about 10 to about 150 ppm.

* * * * *